US006988624B2

(12) United States Patent
MacNaughton

(10) Patent No.: US 6,988,624 B2
(45) Date of Patent: Jan. 24, 2006

(54) VIBRATING SCREEN WITH A LOADING PAN

(76) Inventor: Douglas J. MacNaughton, P. O. Box 402 12486 Highway 217, Digby, Nova Scotia (CA) B0V 1A0

( * ) Notice: Subject to any disclaimer, the term of this patent is extended or adjusted under 35 U.S.C. 154(b) by 97 days.

(21) Appl. No.: 10/697,252

(22) Filed: Oct. 31, 2003

(65) Prior Publication Data

US 2005/0092659 A1 May 5, 2005

(51) Int. Cl.
*B07B 1/28* (2006.01)

(52) U.S. Cl. ..... 209/420; 209/325; 209/409; 209/421; 209/315

(58) Field of Classification Search ..... 209/309, 209/310, 320, 364, 365.1, 365.2
See application file for complete search history.

(56) References Cited

U.S. PATENT DOCUMENTS

| | | | | |
|---|---|---|---|---|
| 416,464 A | | 12/1889 | Laufenburg | |
| 1,182,770 A | | 5/1916 | Kelly | |
| 1,401,370 A | | 12/1921 | Sterling | |
| 1,495,850 A | * | 5/1924 | Armand | 74/26 |
| 1,598,469 A | | 9/1926 | Wigginton | |
| 1,649,883 A | * | 11/1927 | Woodward | 209/349 |
| 2,312,477 A | * | 3/1943 | Pollitz | 209/329 |
| 3,420,658 A | | 1/1969 | Reding et al | |
| 3,454,162 A | * | 7/1969 | Cover | 209/269 |
| 4,197,194 A | * | 4/1980 | Read | 209/325 |
| 4,256,572 A | * | 3/1981 | Read | 209/257 |
| 4,572,782 A | | 2/1986 | Smith et al. | |
| 4,699,713 A | | 10/1987 | Tieben | |
| 4,798,020 A | | 1/1989 | George et al. | |
| 4,839,036 A | * | 6/1989 | Slesarenko | 209/315 |
| 4,923,597 A | * | 5/1990 | Anderson et al. | 209/420 |
| 5,082,555 A | | 1/1992 | Read | |
| 5,100,537 A | | 3/1992 | Krause | |
| 5,234,564 A | * | 8/1993 | Smith | 209/241 |
| 5,244,098 A | * | 9/1993 | Hadden | 209/243 |
| 5,482,165 A | | 1/1996 | Johnston | |
| 5,749,471 A | * | 5/1998 | Andersson | 209/314 |
| 5,899,340 A | | 5/1999 | MacNaughton | |
| 6,575,304 B2 | * | 6/2003 | Cudahy | 209/365.3 |
| 6,843,376 B2 | * | 1/2005 | Dube et al. | 209/421 |

FOREIGN PATENT DOCUMENTS

| | | |
|---|---|---|
| CA | 2105232 | 8/1993 |
| GB | 2223963 | 4/1990 |

* cited by examiner

*Primary Examiner*—Donald P. Walsh
*Assistant Examiner*—Jonathan R Miller
(74) *Attorney, Agent, or Firm*—Mario Theriault

(57) ABSTRACT

The vibrating screen has a frame, a screen box, two pairs of springs supporting the screen box over the frame and a driven eccentric shaft mounted under the screen box. The vibrating screen is characterized by a loading pan affixed to the upper end of the screen box. The loading pan has a central region over the upper springs such that a flexion of the structural members under the loading pan is minimum. The loading pan is wider than the screen box and has sloped sides forming a funnel on the upper end of the screen box to retain the side portions of a load until most of the central portion has been moved to the screen box. In another aspect, each spring has torsion bushings therein, with a pair of arms joining the torsion bushings and forming an angle pointing toward the lower end of the screen box.

20 Claims, 4 Drawing Sheets

VIBRATING SCREEN WITH A LOADING PAN

FIELD OF THE INVENTION

This invention pertains to vibrating screens for screening gravel, top soil, and the like, and more particularly, it pertains to a vibrating screen having a loading pan thereon for receiving loads of screenable material from a bucket loader and for controlling the flow of these loads to the screen box.

BACKGROUND OF THE INVENTION

Small and portable vibrating screens are used for examples, by landscape contractors, gardeners, farmers, and excavation and trucking companies. These vibrating screens are usually loaded by small Skid-Steer™ loaders or other similar front-end bucket loaders. This type of small portable vibrating screens is illustrated and described in Applicant's U.S. Pat. No. 5,899,340 issued on May 4, 1999.

When a load of gravel is dropped all at once in the upper end of a common vibrating screen, the upper springs become compressed, thereby collapsing the upper half of the screen box for a few seconds. During that period, the amplitude of the vibration of the screen box is reduced at the top and increased at the bottom. The screening action is correspondingly reduced at the top. The efficiency of the vibrating screen remains low until the upper springs can recover their operating shapes. This collapsing of a vibrating screen under sudden loads is typical of all common machines having coil springs set vertically under the screen box. Most small portable vibrating screens of the prior art have this type of spring arrangement and suffer from the same drawback.

Therefore, it is believed that there is a market need for a small portable vibrating screen which can maintain a better efficiency when a load of screenable material is dropped in the upper end of the screen box.

A first attempt to reduce the collapsing of the upper end of a vibrating screen has been disclosed in the U.S. Pat. No. 5,082,555, issued to James L. Read on Jan. 21, 1992. In this invention, the vibrating screen has a tilting hopper laid over and covering the screen box. The screenable material is dropped into this hopper by a front-end loader. The hopper is pivoted on the upper end of the machine's frame, and is raised and lowered by hydraulic cylinders. The hopper has a discharge end which coincides with the top end of the screen box. Once loaded, the hopper is tilted at a desired speed to control the flow of screenable material to the screen box.

Although this hopper feeding system has undeniable merits, it has several moving parts and is controlled by an electric timer and a photoelectric switch. These control devices and moving parts are subject to deterioration from dust and shocks associated with the environment in which a vibrating screen operates. Therefore, it is believed that there continues to be a need for a sturdy and maintenance free loading arrangement to control the flow of material in a vibrating screen.

SUMMARY OF THE INVENTION

In the vibrating screen according to the present invention, there is provided a static combination of elements which contribute cooperatively and individually to control the flow of screenable material to the screen box.

In a first aspect of the present invention, there is provided a vibrating screen for separating fine materials from coarse materials. The vibrating screen comprises a frame having a vertical tall end, a vertical short end and a screen box having an upper end, a lower end, a top screen therein and an inclination from the horizontal plane. A first pair of springs are affixed to the tall end of the frame for supporting the upper end of the screen box over the tall end of the frame, and a second pair of springs are affixed to the short end of the frame and to the lower end of the screen box for supporting the lower end of the screen box over the short end of the frame. The vibrating screen also has an eccentric shaft affixed to the screen box and a drive means affixed to the frame and to the eccentric shaft for rotating the eccentric shaft and for imparting a reciprocal movement to the screen box.

The vibrating screen according to this first aspect of the present invention is characterized by a loading pan affixed to the upper end of the screen box, and rigid structural members extending under the screen box and the loading pan for maintaining the loading pan in a same plane as the screen box. The loading pan is set substantially over the upper springs such that a flexion of the structural members in use under the loading pan is minimum.

In accordance with another aspect of the present invention, the loading pan is wider than the screen box. More specifically, the loading pan is about 60% wider than the screen box. The loading pan has a plated bottom surface and sloped sides forming a funnel on the upper end of the screen box. In use, the sloped sides retain about 30% or more of a load of screenable material in the loading pan until most of the central portion of the load has been moved over to the top screen. The flow of screenable material from the loading pan to the top screen is thereby more uniform.

In yet another aspect of the present invention, each of the first and second pairs of springs have torsion bushings therein, and a pair of arms joining the torsion bushings and forming an acute angle pointing toward the lower end of the screen box. The top arm in each spring makes an angle with the horizontal plane, which is greater than the inclination of the screen box. Because of this characteristic, the friction forces caused by a load of screenable material in the loading pan produce a torque on each spring in a direction opposite a vertical loading on each spring, to reduce a collapsing of the springs in use.

Still another feature of the vibrating screen of the present invention is that it is susceptible of a low cost of manufacture with regard to both materials and labour, and which accordingly is then susceptible of low prices of sale to the consumer, thereby making such vibrating screen economically available to the public.

Other advantages and novel features of the present invention will become apparent from the following detailed description of the preferred, embodiment.

BRIEF DESCRIPTION OF THE DRAWINGS

One embodiment of the present invention is illustrated in the accompanying drawings, in which like numerals denote like parts throughout the several views, and in which.

DESCRIPTION OF THE PREFERRED EMBODIMENT

Figure 1:
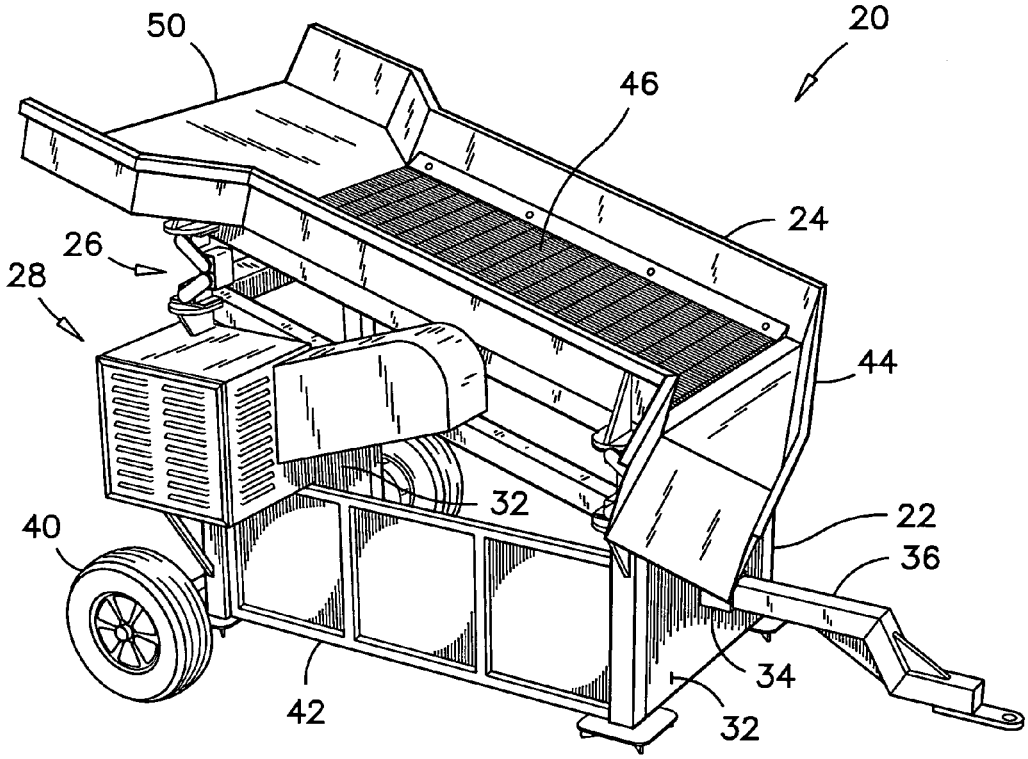
FIG. 1 is a perspective side, top and front view of the vibrating screen according to the preferred embodiment of the present invention.

While this invention is susceptible of embodiment in many different forms, there is shown in the drawings and will be described in details herein one specific embodiment, with the understanding that the present disclosure is to be considered as an example of the principles of the invention and is not intended to limit the invention to the embodiment illustrated and described.

Figure 2:
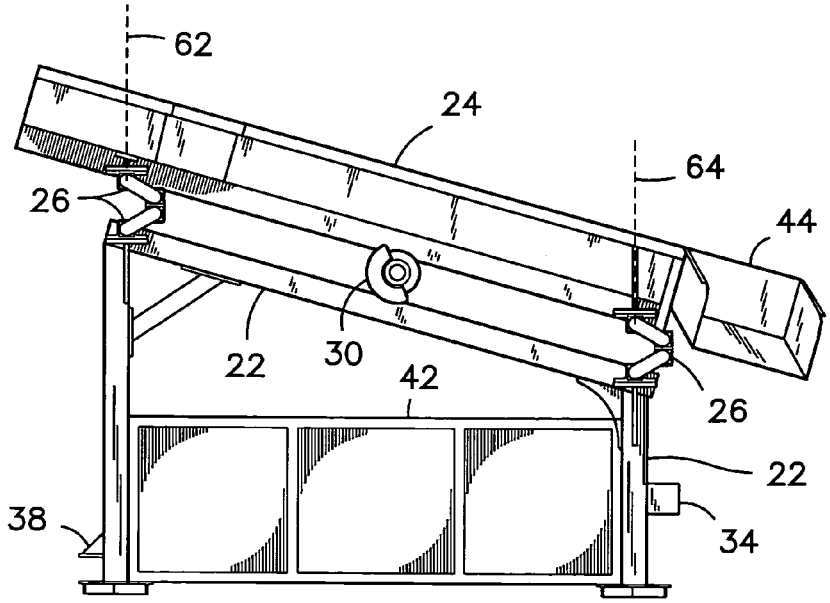
FIG. 2 is a partial side view of the vibrating screen.

Referring to FIGS. 1 and 2, the vibrating screen 20 according to the preferred embodiment is described herein below in a general form. The preferred vibrating screen 20 has an arched frame 22 supporting a screen box 24 on four springs 26 affixed to the top of the frame 22. An engine 28 drives an eccentric shaft 30 affixed to the screen box 24, to impart a vibrating movement to the screen box 24.

The preferred springs 26 are of the type known as oscillating mountings, manufactured by ROSTA-WERK AG, a company from Switzerland having distributors throughout the world. Each spring 26 is characterized by two pairs of torsion bushings each comprising a square stub embedded in a rubber-packed housing. A torsion bushing in each pair share a common housing. The torsion bushings are perpendicularly affixed to two arms making an acute angle having a closed end near the common housing. These springs are known in the industry as ROSTA™ springs.

The frame 22 of the vibrating screen has a short end and a tall end. Both ends comprise ballast 32 between the vertical frame members to stabilize the vibrating screen in use. The short end ballast has a socket 34 there through to receive a tow hitch 36, and the tall end has brackets 38 thereon to receive an axle and wheel set 40 for transporting the vibrating screen between job sites.

A panel 42 extends along one side of the frame 22 to form with both ends of the frame an enclosure under the vibrating screen to retain a pile of fines under the vibrating screen.

Figure 9:
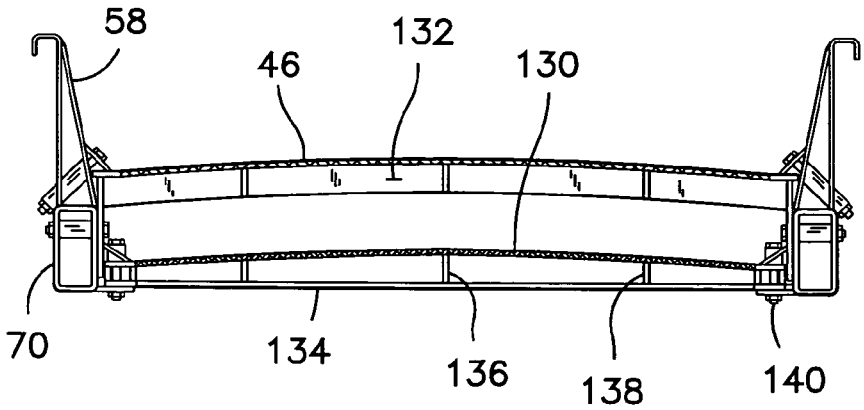
FIG. 9 is a cross-section view of the screen box taken across the longitudinal axis of the screen box, substantially along line 9—9 in FIG. 3.

The screen box 24 has a discharge chute 44 on its lower end extending to one side of the frame next to the panel 42, to accumulate the rejects of the top screen 46 at that location. Although only the top screen 46 is visible in the drawings, a second screen may be provided under the top screen to produce a third grade of screened material. The discharge end of the second screen is next to the short end of the vibrating screen, under the chute 44. A second screen will be described later and is illustrated in FIG. 9.

The frame 22 of the vibrating screen, the engine 28, the eccentric shaft 30 the towing accessories 34, 36, 38 and 40, and the chute 44 are not described further herein for not being the focus of the present invention.

Figure 4:
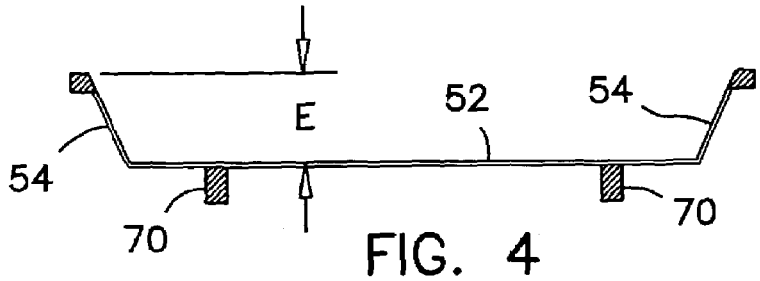
FIG. 4 is a cross-section view of the loading pan as seen along line 4—4 in FIG. 3.
Figure 3:
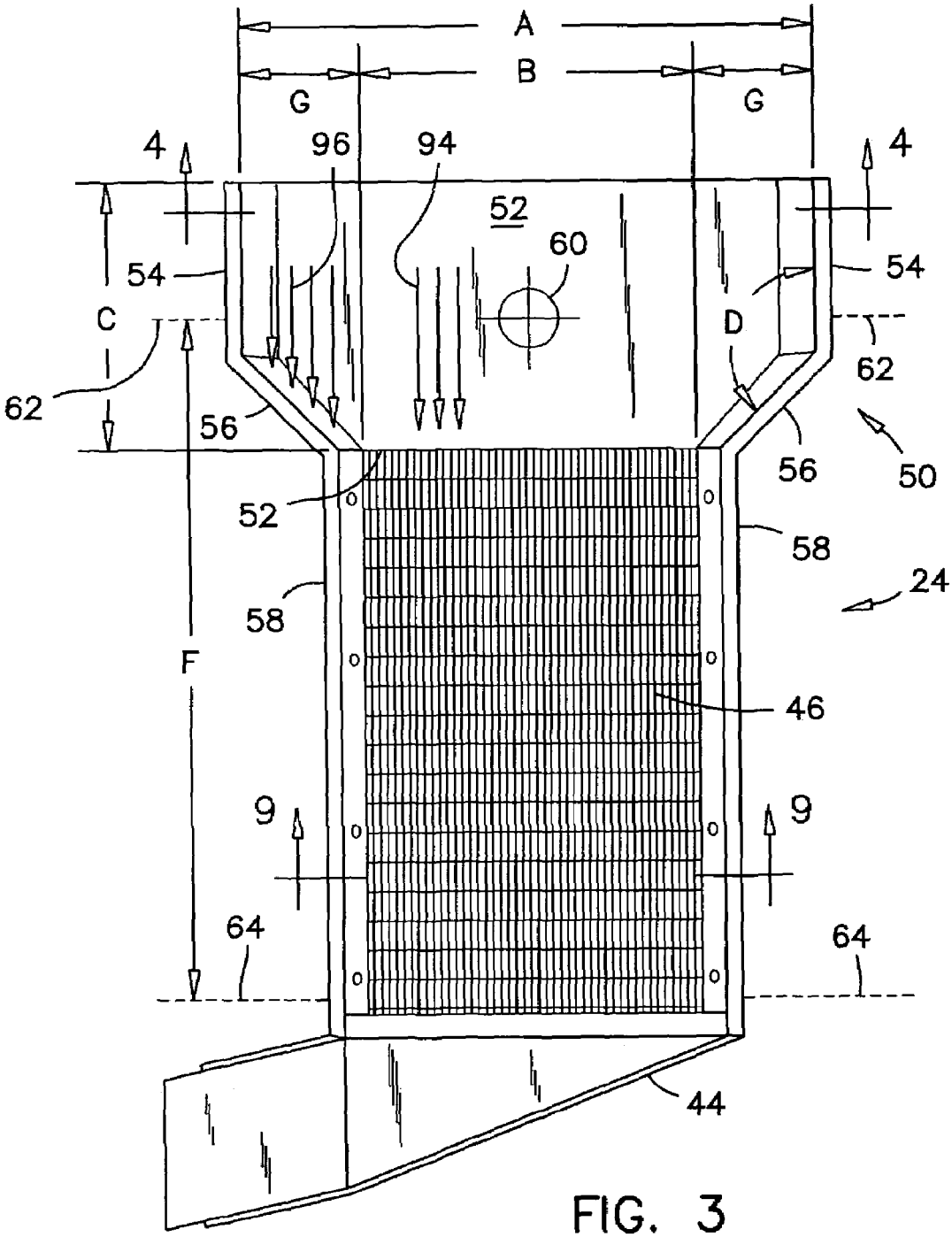
FIG. 3 is a top view of the screen box.

Referring now to FIGS. 3 and 4, one of the features of the vibrating screen 20 will be described. The screen box 24 is made of metal plates and metal structural members enclosing the top screen 46. The screen box 24 has a loading pan 50 on its upper end, above the upper edge 52 of the top screen 46. The loading pan 50 is also made of metal plates and metal structural members. The preferred width 'A' of the loading pan is at least about 1.5 times, and preferably 1.6 times or more, the width 'B' of the top screen. A 48 inch-wide screen for example has a preferred loading pan width 'A' of about 78 inches. This dimension has been found advantageous for loading the vibrating screen with a Skid-Steer™ loader or a similar small bucket loader.

The preferred length of the loading pan 'C' is about 24 inches, such that the loading pan 50 can receive the entire load of a small bucket loader. The loading pan 50 has a central plated surface 52 defined by inclined side surfaces 54. The loading pan 50 also has inclined sloped surfaces 56 defining a funnel between the inclined side surfaces 54 and the sides 58 of the screen box 24. Each sloped surface 56 forms an angle 'D' between 120° and 150°, and preferably about 135° with a respective inclined side surface 54, or with a respective side 58 of the screen box. The depth 'E' of the loading pan 50 is about the same as the depth of the screen box 24.

The central region 60 of the loading pan 50 preferably lies upon the axis 62 of the upper springs 26, although there are also advantageous results to be obtained with the central region 60 of the loading pan 50 lying on the screen side of this axis, within the span 'F' between the axis 62 of the upper springs and the axis 64 of the lower springs. These advantageous results will be explained later when making reference to FIG. 6, in particular.

It is to be noted that the shape of the loading pan 50 causes a load of screenable material to be partially and temporarily retained inside the loading pan, and to be released therefrom in a controlled manner. The projections 'G' of the sloped surfaces 56 across the loading pan 50 constitute at least one third, and more precisely, about 38% of the total width of the loading pan. Therefore, a similar proportion of a load of screenable material dumped into the loading pan is temporarily retained against these sloped surfaces 56 until a central portion of the load has been moved over to the top screen 46.

It will be appreciated that a load of screenable material inside the loading pan is also partially and temporarily retained therein by friction forces against the bottom surface 52 of the loading pan 50. It has been found that the shape of the loading pan causes a load of screenable material to flow in sequence from the top to the bottom of the central portion and then from the centre to the sides thereof, with the side portions flowing last. It has been found that this flow sequence helps to control the amount of screenable material moving to the top screen 46, and contributes to maintaining the efficiency of the vibrating screen from the start to the end of each load.

Figure 5:
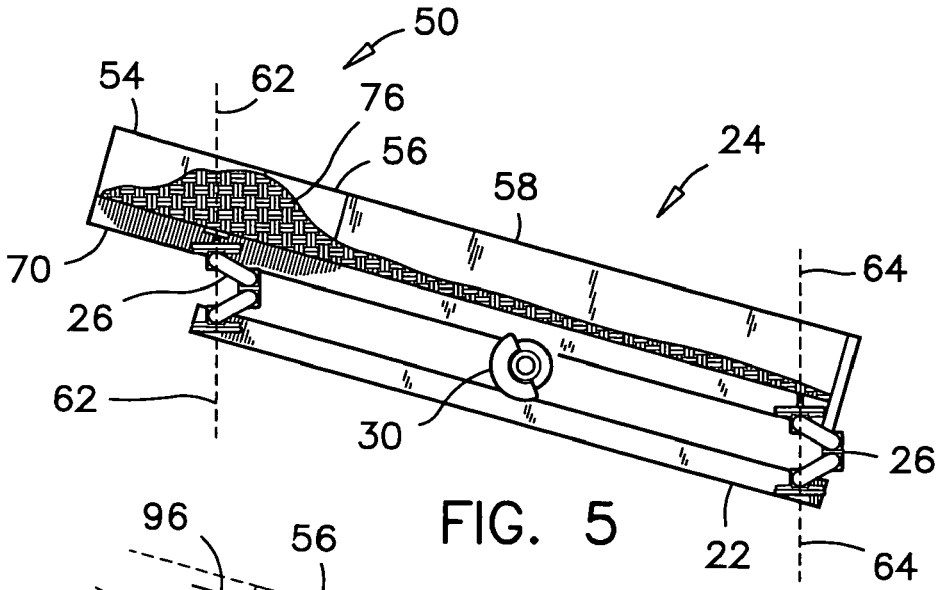
FIG. 5 is another partial side view of the vibrating screen with the screen box shown in a cut-away view to show a load of screenable material therein.

The centring of the load upon the axis 62 of the upper springs also contributes to improving the flow of material over the screen surface. As can be appreciated from the illustrations in FIGS. 5 and 6, the screen box 24 and the loading pan 50 are on a same pair of structural members 70, with the loading pan 50 centred on the axis 62 of the upper springs 26, as mentioned before. In use, the structural members 70 flex up and down in reaction to the rotation of the eccentric shaft 30, as illustrated in FIG. 6.

Figure 6:
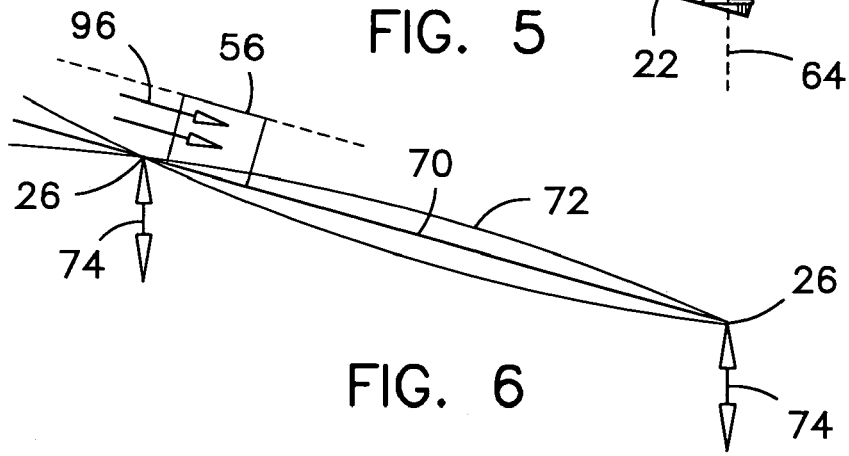
FIG. 6 is a diagram representing the flexion of the structural members under the screen box in use.

It will be appreciated that the amplitude 72 of the vibration shown in an exaggerated manner in FIG. 6 is maximum at a mid-span of the structural members and is minimum at the springs 26. This flexion amplitude added to the displacements 74 of the springs causes the vibration of the screen box to be maximum at the mid-span of the screen box and minimum at the upper and lower axes 62, 64. This minimum vibration at the central region 60 of the loading pan 50 also contributes to improving the uniformity of a flow of screenable material from the loading pan to the screen box.

It will also be appreciated that the position of the loading pan in-line with the axis of the upper springs or within the span 'F' of the springs contributes to reducing any cantilevered loading on the structural members 70. It is known that such cantilevered loading would occur if the loading pan would be centred well above the upper springs. It is also known that such cantilevered loading can cause a deflection in the structure of a screen box which is out-of-phase with the rotation of the eccentric shaft, and damage the vibrating screen.

Figure 7:
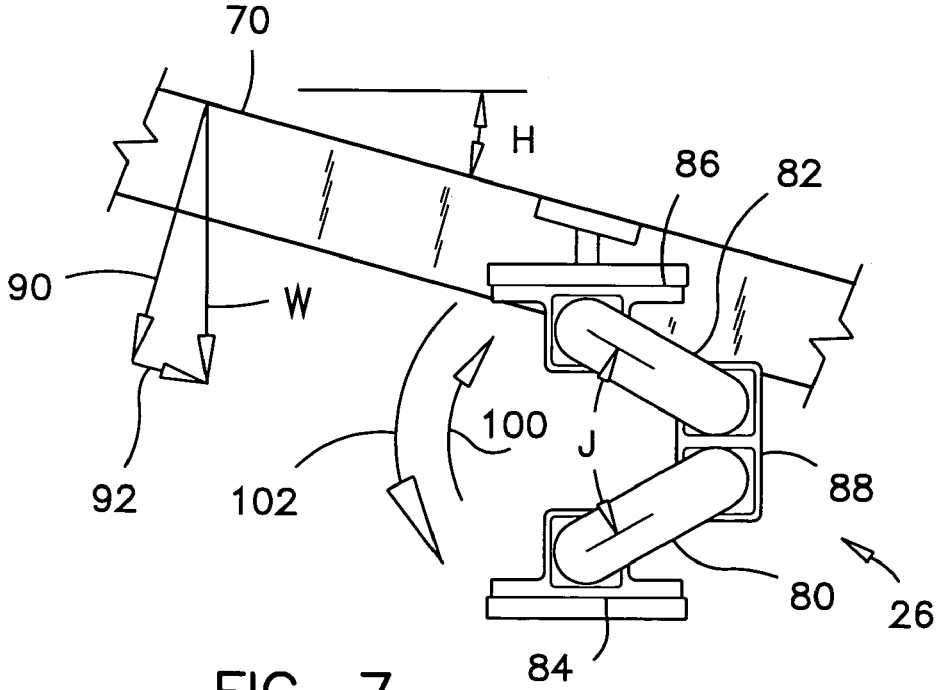
FIG. 7 is another side view of the vibrating screen showing one of the springs supporting the screen box.

Another feature of the present invention will be described while making reference to FIG. 7 in particular. The structural members 70 under the screen box 24 and the loading pan 50 are preferably set at an inclination 'H' of about 18° from the horizontal plane for screening loam, peat moss and the like, and at 22° for screening sand and gravel.

As mentioned herein before, each spring 26 has two arms 80, 82 joining two pairs of torsion bushings. The lower mounting housing 84 is affixed to the frame 22 of the vibrating screen, and the upper housing 86 is affixed to the screen box 24. The other two torsion bushings are mounted in the common housing 88.

The springs 26 are selected to maintain in use, and angle 'J' of about 45° to 90° between the arms 80, 82 with the closed end of this acute angle near the common housing 88. The mounting surfaces of the housings 84, 86 are set horizontally, and the closed end of the acute angle 'J' is pointing toward the lower end of the screen box 24.

For the purpose of understanding the following discussion, it should be noted that the upper arm 82 in each spring 26 is always inclined from the horizontal plane, at an angle larger than the inclination 'H' of the screen box 24.

The weight 'W' of a load of screenable material 76 generates a cosine force 90 perpendicular to the surface 52 of the loading pan 50, and a sine force 92 tangent to, or in-line with the structural members 70 under the screen box 24. The sine force 92 between a load of screenable material and the surface 52 of the loading pan 50 is composed of surface friction forces as illustrated by arrows 94 in FIG. 3, and holding forces applied by the sloped surfaces 56, as illustrated by arrows 96. A complete analysis of the magnitude of these forces is not necessary to understand the principle of the present invention. Generally, the sum of these forces 94, 96 is always related the total weight of a load 76 in a proportion corresponding to the sine 92 of the inclination 'H' of the screen box.

With a screen box inclined at an angle 'H' of between 18° to 22°, the friction forces 94, 96, and consequently the sine force 92 at each spring 26 corresponds to the sine of that angle times the weight of the load 'W'. In other words, the sine force 92 on each spring 26 corresponds to between 30% to 37% of the total load 'W' supported by that spring.

Because each spring 26 is mounted with the angle 'J' of the arms 80, 82 pointing toward the short end of the screen box, and the top arm 82 is angled downward from the structural members 70, the sine force 92 translated to the upper housing 86 applies a torque 100 on the spring 26 in a direction causing the spring to extend. This torque 100 is opposite from the torque 102 caused by the cosine component 90 of the load 'W'. While the cosine component 90 of a load tends to collapse the spring 26, the sine component 92 tends to extend the spring. For this reason, the total deflection of each spring 26 is not as much as in same size vibrating screen having coil springs for example. The initial collapsing of the upper springs when a load is dumped all at once in the screen box is thereby not as severe as compared to vibrating screens of the prior art.

Figure 8:
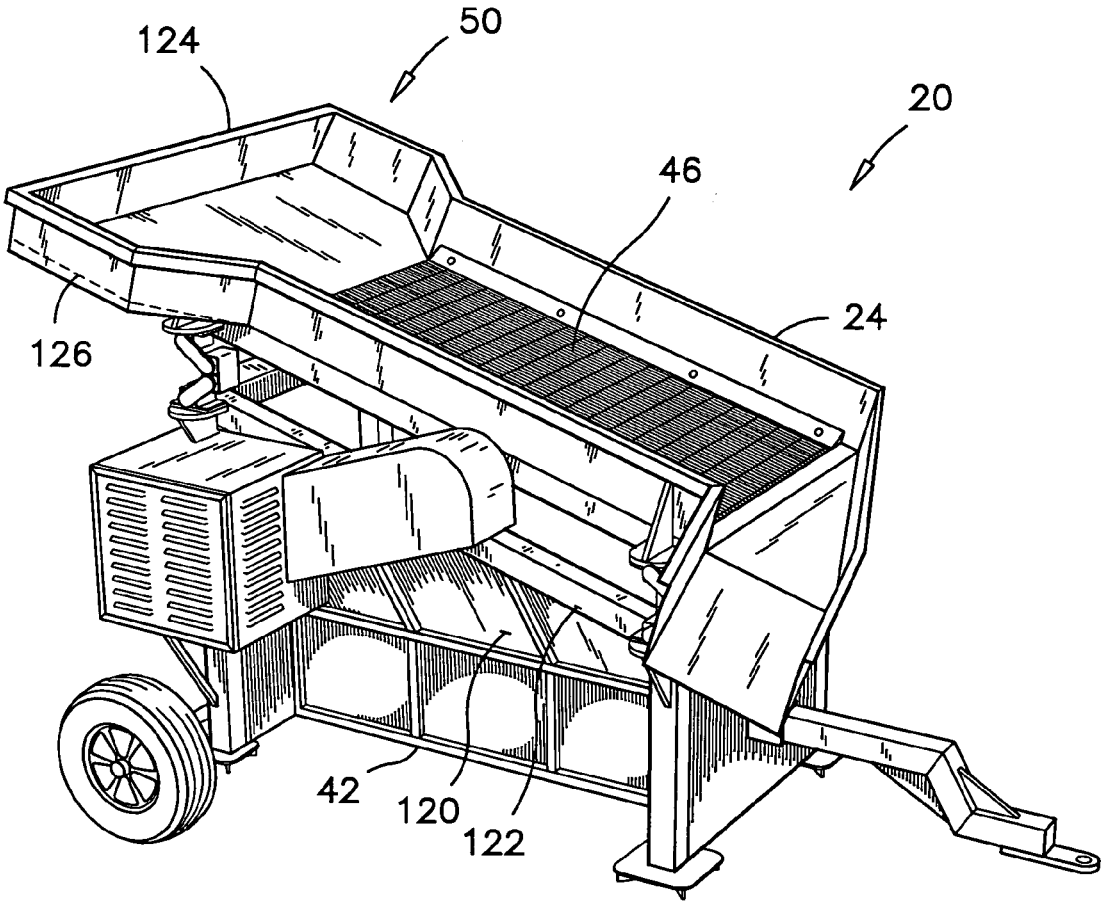
FIG. 8 is another perspective side, top and front view of the vibrating screen according to the preferred embodiment of the present invention, showing various optional features therefor.

Referring now to FIGS. 8 and 9, there are illustrated therein four optional features that are advantageous to accommodate different situations.

Firstly, a small, short-arm loader with a shallow bucket may have difficulty reaching under the vibrating screen 20 to handle all the fine material therefrom. In these situations, the panel 42 is preferably mounted inside the frame 22 directly under the top screen 46. In this arrangement, a deflector 120 joins the top edge of the panel 42 to the side framing member 122, to deflect the fines to the far side of the vibrating screen 20 relative to the view illustrated in FIG. 8.

In a second option, the rear edge of the loading pan is preferably enclosed by a plate 124 as illustrated in FIG. 8, when working with non-adhering material in a vibrating screen that is set at the lower preferred inclination. The plate 124 prevents runout of screenable material toward the rear end of the machine. The plate 124 also facilitates the loading of the loading pan using a small bucket loader having limited horizontal reach with the arms in a raised position.

When production is more important than material retention inside the loading pan, the bottom surface of the loading pan, as shown by dotted line 126 in FIG. 8, is preferably inclined more than of the top screen 46 by an angle of about 4°–5°. This slope promotes a faster delivery of material to the top screen 46.

Lastly, the screening of moist and sticking materials can represent a challenge to manufacturers of vibrating screens. A good solution to this problem has been obtained by providing a crown of about 1" over 48" across both the top screen 46 and the bottom screen 130 as illustrated in FIG. 9. It has been found that these curvatures promote an even distribution of materials over the screen surfaces.

In the screen of the present invention, the top screen 46 is supported by transversely curved flat bars 132. The bottom screen 130 is supported by a rectangular insert 134 having longitudinal flat bars 136, 138 of different widths, mounted on their edges. The rectangular insert 134 is preferably fastened to the structural members 70 of the screen box by bolts 140, such that it is easily removable for replacement with a flat screen when necessary.

As to other manner of usage and operation of the present invention, the same should be apparent from the above description and accompanying drawings, and accordingly further discussion relative to the manner of usage and operation of the vibrating screen would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. A vibrating screen for separating fine materials from coarse materials, comprising;

a frame having a vertical tall end and a vertical short end;

a screen box having an upper end, a lower end, a top screen mounted therein, and an inclination from a horizontal plane;

a first pair of springs affixed to said tall end and said upper end for supporting said upper end over said tall end;

a second pair of springs affixed to said short end and said lower end for supporting said lower end over said short end;

an eccentric shaft affixed to said screen box and a drive means affixed to said frame and said eccentric shaft for rotating said eccentric shaft and for imparting a reciprocal movement to said screen box, and a loading pan affixed to said upper end of said screen box; said loading pan having a plated bottom surface extending substantially in a same plane as said top screen, and a central region set vertically in line with said first pair of springs.

2. The vibrating screen as claimed in claim 1, wherein said loading pan is wider than said screen box, and has sloped sides forming a funnel on said upper end of said screen box.

3. The vibrating screen as claimed in claim 2, wherein each of said sloped sides makes an angle of between 120° and 150° with an outside edge of said screen box.

4. The vibrating screen as claimed in claim 2, wherein said loading pan is about 60% wider than said screen box.

5. The vibrating screen as claimed in claim 1, wherein each of said first and second pairs of springs has torsion bushings therein and a pair of arms joining said torsion bushings and forming an acute angle there between; said acute angles in both said first and second pairs of springs pointing toward said lower end of said screen box.

6. The vibrating screen as claimed in claim 5, wherein each of said pair of arms comprises an upper arm angled downward from said inclination of said screen box.

7. The vibrating screen as claimed in claim 5, wherein said inclination of said screen box is between 18° and 22°, and said acute angle of said pair of arms in each of said springs is between 45° and 90°.

8. A vibrating screen for separating fine materials from coarse materials, comprising;

a frame having a vertical tall end and a vertical short end;

a screen box having an upper end, a lower end, a top screen therein, and an inclination from a horizontal plane;

a first pair of springs affixed to said tall end and said upper end for supporting said upper end over said tall end;

a second pair of springs affixed to said short end and said lower end for supporting said lower end over said short end, an eccentric shaft affixed to said screen box and a drive means affixed to said frame and said eccentric shaft for rotating said eccentric shaft and for imparting a reciprocal movement to said screen box, a loading pan affixed to said upper end of said screen box and having means for temporarily retaining a portion of a load of screenable material therein; and each of said first and second pairs of springs having torsion bushings therein, and a pair of arms joining said torsion bushings and forming an acute angle there between; said acute angles in both said first and second pairs of springs pointing toward said lower end of said screen box.

9. The vibrating screen as claimed in claim 8, wherein said inclination of said screen box is between 18° and 22°, and said acute angle of said pair of arms in each of said springs is between 45° and 90°.

10. The vibrating screen as claimed in claim 8, wherein said loading pan has a plated bottom surface extending substantially in a same plane as said top screen.

11. The vibrating screen as claimed in claim 10, wherein said loading pan is wider than said screen box.

12. The vibrating screen as claimed in claim 10, wherein said means for temporarily retaining comprises sloped sides forming a funnel on an upper end of said screen box.

13. The vibrating screen as claimed in claim 12, wherein said loading pan is 60% wider than said screen box.

14. The vibrating screen as claimed in claim 10, wherein said loading pan has a central region set vertically in-line with an axis of said first pair of springs.

15. The vibrating screen as claimed in claim 8, wherein said loading pan has a plated bottom surface enclosed on three sides.

16. The vibrating screen as claimed in claim 15, wherein said plated bottom surface is inclined at a steeper angle than said top screen.

17. A vibrating screen for separating fine materials from coarse materials, comprising;

a frame having a vertical tall end and a vertical short end;

a screen box having an upper end, a lower end, a top screen mounted therein, and an inclination from a horizontal plane;

a first pair of springs affixed to said tall end and said upper end for supporting said upper end over said tall end;

a second pair of springs affixed to said short end and said lower end for supporting said lower end over said short end;

an eccentric shaft affixed to said screen box and a drive means affixed to said frame and said eccentric shaft for rotating said eccentric shaft and for imparting a reciprocal movement to said screen box, and a loading pan affixed to said upper end of said screen box; and loading pan being wider than said screen box.

18. The vibrating screen as claimed in claim 17, wherein said loading pan is at least 50% wider than said screen box.

19. The vibrating screen as claimed in claim 18, wherein said loading pan as a central region set vertically in line with said first pairs of springs.

20. The vibrating screen as claimed in claim 17, wherein said loading pan has a plated bottom surface extending substantially in a same plane as said top screen in said screen box.

* * * * *